US011064762B2

(12) United States Patent
Grønlykke

(10) Patent No.: US 11,064,762 B2
(45) Date of Patent: Jul. 20, 2021

(54) SHOE, A PATCH AND A METHOD FOR PREVENTING ANKLE INJURIES

(71) Applicant: SPRAINO IP APS, Copenhagen (DK)

(72) Inventor: Thor Buch Grønlykke, Copenhagen (DK)

(73) Assignee: SPRAINO IP APS, Copenhagen O (DK)

( * ) Notice: Subject to any disclaimer, the term of this patent is extended or adjusted under 35 U.S.C. 154(b) by 10 days.

(21) Appl. No.: 15/739,571

(22) PCT Filed: Jun. 24, 2016

(86) PCT No.: PCT/EP2016/064722
§ 371 (c)(1),
(2) Date: Dec. 22, 2017

(87) PCT Pub. No.: WO2016/207381
PCT Pub. Date: Dec. 29, 2016

(65) Prior Publication Data

US 2018/0317603 A1 Nov. 8, 2018

(30) Foreign Application Priority Data

Jun. 26, 2015 (EP) ..... 15174092

(51) Int. Cl.
*A43B 13/02* (2006.01)
*A43B 7/19* (2006.01)
(Continued)

(52) U.S. Cl.
CPC ..... *A43B 13/02* (2013.01); *A43B 7/19* (2013.01); *A43B 7/20* (2013.01); *A43B 13/26* (2013.01); *A43C 13/00* (2013.01); *A43C 13/06* (2013.01)

(58) Field of Classification Search
CPC ..... A43B 13/26; A43B 13/02; A43B 13/023; A43B 13/04; A43B 13/08; A43B 13/10;
(Continued)

(56) References Cited

U.S. PATENT DOCUMENTS 1,984,989 A * 12/1934 Reed ..... A43B 5/12 36/113
2,572,671 A * 10/1951 Shaw ..... A43B 5/12 280/11.12

(Continued)

FOREIGN PATENT DOCUMENTS

CN 201929125 U 8/2011
CN 102754962 A 10/2012

(Continued)

OTHER PUBLICATIONS

European Search Report from EP Search Report EP15174092, dated Nov. 13, 2015.

(Continued)

*Primary Examiner* — Sharon M Prange
*Assistant Examiner* — Grace Huang
(74) *Attorney, Agent, or Firm* — Workman Nydegger

(57) ABSTRACT

A shoe for preventing ankle injuries comprises a sole with a ground-engaging surface, and lateral and medial edges associated with respective lateral and medial connecting portions interconnecting and extending between the ground-engaging surface and the lateral and medial edges. At least one of the connecting portions defines a surface area of reduced friction provided, e.g., in the form of retrofitted patches, which are circumferentially surrounded by adjacent surface areas having a relatively high coefficient of friction. Friction is differentiated in different areas of those parts of the shoe which are implicated in injury mechanisms, and injuries may thus be prevented in the recovery phase after injury, and
(Continued)

primary prophylaxis may be achieved. The area of reduced friction reduces the ability of the wearer's foot to rotate relative to ground when the load of the wearer's body is shifted towards or lands near the edge of the shoe.

13 Claims, 7 Drawing Sheets

(51) Int. Cl.
*A43B 7/20* (2006.01)
*A43C 13/06* (2006.01)
*A43C 13/00* (2006.01)
*A43B 13/26* (2006.01)

(58) Field of Classification Search
CPC ..... A43B 13/12; A43B 13/16; A43B 13/22; A43B 13/122; A43B 13/125; A43B 13/127; A43B 7/19; A43B 7/20; A43C 13/00; A43C 13/06; A43C 19/00
USPC ..... 36/59 R
See application file for complete search history.

(56) References Cited

U.S. PATENT DOCUMENTS 4,380,878 A * 4/1983 Skaja ..... A43B 13/26 36/129
4,578,883 A * 4/1986 Dassler ..... A43B 5/00 36/116
5,542,198 A * 4/1996 Famolare ..... A43B 5/00 36/130
6,006,451 A 12/1999 Morris et al.
6,055,748 A * 5/2000 Harrison ..... A43C 15/02 36/59 R
6,243,973 B1 * 6/2001 Lind ..... A43B 5/00 36/130
6,270,872 B1 8/2001 Cline et al.
6,311,415 B1 * 11/2001 Lind ..... A43B 5/00 36/130
6,598,324 B1 * 7/2003 Tsuji ..... A43B 1/0081 36/100
7,152,340 B2 * 12/2006 Issler ..... A43B 1/0081 36/15
7,543,399 B2 6/2009 Kilgore et al.
7,594,345 B2 * 9/2009 Fusco ..... A43B 5/06 36/103
8,701,310 B1 4/2014 Walsh
8,789,253 B2 7/2014 Kilgore et al.
9,456,656 B2 * 10/2016 Cross ..... A43B 13/181
10,051,914 B2 8/2018 Cross et al.
2002/0128580 A1 9/2002 Carlson et al.
2002/0144437 A1 * 10/2002 Davis ..... A43B 13/00 36/115
2006/0101671 A1 5/2006 Berend et al.
2007/0107260 A1 * 5/2007 Pasternak ..... A43B 3/0042 36/39
2008/0034617 A1 * 2/2008 Anderson ..... A43B 5/1633 36/116
2008/0307674 A1 12/2008 Dean
2009/0241319 A1 10/2009 Kilgore et al.
2010/0071231 A1 3/2010 Murphy et al.
2010/0269244 A1 10/2010 Nurse et al.
2012/0216428 A1 * 8/2012 Marandos ..... A43B 3/0078 36/130
2012/0272547 A1 * 11/2012 Borel ..... A43B 13/223 36/103
2013/0263476 A1 * 10/2013 Santos ..... A43B 13/16 36/130
2014/0041254 A1 * 2/2014 Bannister ..... A43B 23/00 36/73
2014/0290099 A1 * 10/2014 Corbett ..... A43B 13/181 36/103
2019/0059453 A1 * 2/2019 Thibodeau ..... A43B 11/00

FOREIGN PATENT DOCUMENTS

DE 20010886 U1 10/2000
EP 0133563 A1 2/1985
EP 1554943 A1 7/2005
EP 2517588 A2 10/2012
FR 2803493 A1 7/2001
JP 2011056274 A 3/2011
JP 2012228516 A 11/2012
TW 201244657 A 11/2012
WO 9965434 A1 12/1999
WO 2010085160 A1 7/2010
WO 2012135071 A2 10/2012

OTHER PUBLICATIONS

International Search Report and Written Opinion from PCT Application No. PCT/EP2016/064722, dated Sep. 2, 2016.
International Preliminary Report on Patentability from PCT Application No. PCT/EP2016/064722, dated Oct. 9, 2017.
"WA-21-014—Double Sided Tissue Tape," Stokvis Tapes, Sep. 11, 2008, 1 Page.
"KA-21-010—Double Sided PP Tape," Stokvis Tapes, Nov. 10, 2006, 1 Page.
"SG22552—PTFE Tape," Stokvis Tapes, Jun. 8, 2009, 1 Page.
"1450—DS Clothtape," Stokvis Tapes, Feb. 9, 2010, 1 Page.
Hupperets et al., "Potential Savings of a Program to Prevent Ankle Sprain Recurrence," The American Journal of Sports Medicine, vol. 38, No. 11, 2010, pp. 2194-2200.
"Personal Protective Equipment-Footwear-Test Method for Slip Resistance," ISO 13287, Dansk Standard, Dec. 5, 2012, 30 Pages.
Shorten et al., "Shoe-Surface Traction of Conventional and In-Filled Synthetic Turf Football Surfaces," Downloaded on Dec. 20, 2017, 6 Pages.
Search Report from corresponding CN Application No. 2016800370720, dated Jan. 10, 2020.

* cited by examiner

Fig. 4
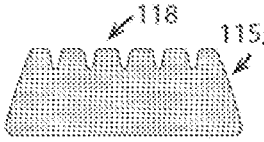
Fig. 5
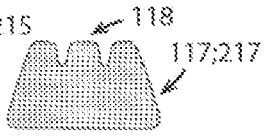
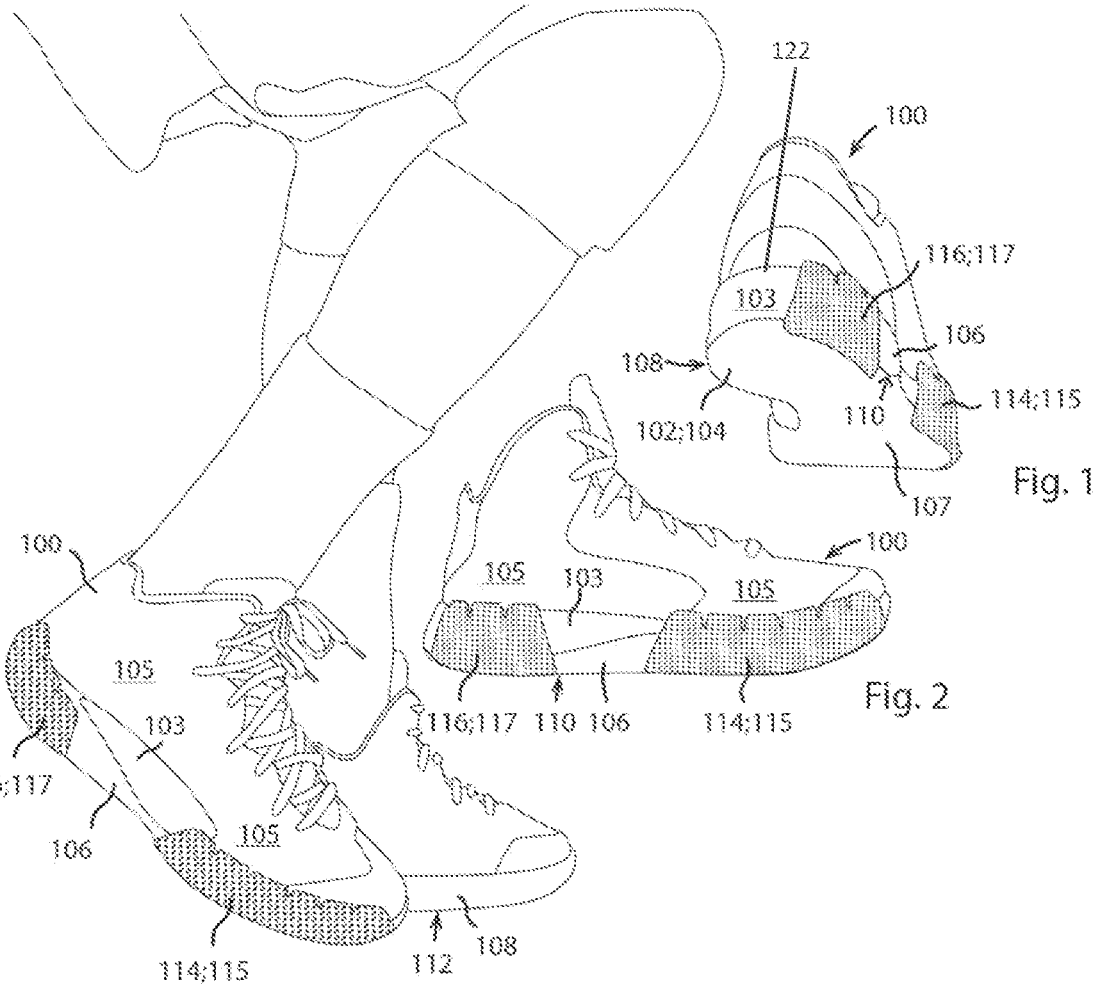
Fig. 1
Fig. 2
Fig. 3

SHOE, A PATCH AND A METHOD FOR PREVENTING ANKLE INJURIES

TECHNICAL FIELD

The present invention generally relates to a shoe tailored to reduce the risk of ankle injuries, typically a sports shoe. The invention also relates to a patch for back-fitting to an existing shoe with a view to preventing ankle injuries. Further the invention relates to a method of preventing ankle injuries in a human wearing a shoe.

BACKGROUND OF THE INVENTION

It has been estimated that ankle injuries account for 15-30% of all injuries in sport. In the United States alone 23,000 injuries are thought to happen every day. The average treatment cost of sprains and strains is $2294 in the US (ASPE Issue Brief, March 2014). Based on these numbers and assuming most ankle injuries are sprains and strains the estimated annual treatment cost for ankle injuries amounts to 3-6 billion dollars. This cost does not include lost productivity caused by injuries, which can be very significant especially for professional high income athletes and very high on a societal level for all the persons occupying a job that require physical activity. In the Netherlands total annual costs related to lateral ankle sprains can roughly be estimated at €187,200,000 (Am J Sports Med November 2010 vol. 38 no. 11 2194-2200). These costs underline the need for better means of preventing ankle injuries.

An estimated 70-80% of athletes who suffer a sprain will have repeated problems. Functional ankle instability and sprains reoccur in about 10-60% of athletes previously subject of acute injury. In these patients a part of the mechanism that causes re-injury is an erroneous sensation of the position of the ankle joint in plantar flexion 30°/inversion 20° whereby the joint can be more plantar-flexed and inverted when landing thus creating a risk of lateral distortion.

Ankle injuries typically occur when the ankle twists uncontrolled in an inversion/supination and plantar flexion motion. This results in a lateral sprain (distortion) but fractures also occur frequently. The sprain causes damage to the calcaneofibular ligament and the talofibular anterior ligament in varying degrees and possibly the tibiofibular anterior ligament as well as the joint capsule and surrounding soft tissue.

The injuries are best treated with physiotherapy that strengthens the muscles and enhances the neuromuscular coordination and reflexes. In most patients, after four months little or no difference can be measured between the injured and non-injured ankle. The injuries can also be treated with taping or semi rigid braces but both methods have significant limitations as they provide a limited support especially for repeated injuries and often degrades freedom of movement for the wearer. Also, the restricting effect of tape is lost after varying periods of exercise (Am J Sports Med November 2010 vol. 38 no. 11 2194-2200).

From a shoe design point of view, prevention of sports injuries has hitherto generally focussed on stability increase of shoes, enhancement of foot support, as well as on improvement of anti-slip properties of shoes. Despite past efforts, it has however been found that a need remains for further development of a shoe which contributes to reducing the occurrence of sports injuries, notably ankle and knee injuries.

SUMMARY OF THE INVENTION

On the above background, a first aspect of the present invention provides a shoe comprising:

- a sole with a ground-engaging surface;
- a lateral edge and a lateral connecting portion interconnecting and extending between the ground-engaging surface of the sole and the lateral edge;
- a medial edge and a medial connecting portion interconnecting and extending between the ground-engaging surface of the sole and the medial edge;

characterised in that

- at least one of said connecting portions defines a surface area of reduced friction, which is circumferentially surrounded by adjacent surface areas of said respective connecting portions, edges and/or ground-engaging surface, and which defines a first coefficient of friction; and
- wherein said first coefficient of friction is lower than a coefficient of friction of each of said surrounding surface areas.

In a second aspect, the invention provides a patch for retrofitted to a shoe for preventing ankle injuries in a human being wearing the shoe, the patch being configured for mounting at least one of

- a lateral edge and a lateral connecting portion interconnecting and extending between the ground-engaging surface of the sole and the lateral edge, and
- a medial edge and a medial connecting portion interconnecting and extending between the ground-engaging surface of the sole and the medial edge
- to confer, to the shoe, a confined surface area, which is circumferentially surrounded by adjacent surface areas of the shoe, and which defines a coefficient of friction of less than 0.5 as tested according to ISO 13287:2012 by mounting the surface of the area of reduced friction on the sole of the test shoe and using the backward slip on the forepart test without lubricant as according to ISO 13287:2012. The surface area of reduced friction extends continuously from a top portion of the lateral edge toward the ground-engaging surface such that the surface area of reduced friction mainly covers the lateral edge relative to the ground-engaging surface, and such that a small portion of the surface area of reduced friction extends slightly beyond the lateral connecting portion to cover a portion of the ground-engaging surface.

In a third aspect, the invention provides a method of preventing ankle injuries in humans, comprising the step of providing the human being with a shoe according to the first aspect of the invention and mounting the shoe on the human being's foot, so as to promote sliding between the shoe and ground upon the occurrence of an unbalanced motion of the human being's foot relative to the ground.

In the present context, injuries should be understood to include, but not be limited to sprains, including syndemosis ruptures, dislocations, strains, and fractures. Injuries could also be understood to include osteochondral lesions.

In the present context, the ground-engaging surface should be understood to be that part of the shoe which engages the ground when the wearer of the shoe is standing up straight and puts equal weight on both feet. The ground-engaging surface may differ from the part of the shoe that engages the ground during movement of the wearer such as jumping, landing, turning, etc.

In the present context, the edge is to be understood as extending from the connecting portion in a direction away from the ground-engaging surface and connecting portion, the edge extending in a direction transverse, i.e. not parallel, to the ground-engaging surface.

Generally, friction is reduced between the surface and the shoe's lateral or medial connecting portion interconnecting the ground-engaging surface and the lateral or medial edge of the shoe. This reduction of friction is key to prevent ankle sprains as most sprains happen with the foot in contact with the ground during landing or other movements at which the foot interacts with ground in an unpredicted or unbalanced manner, such as when the foot lands on an opponent's foot or positions itself incorrectly relative to ground. Moreover, the area of reduced friction ensures increased mobility of the shoe when the area of reduced friction is in contact with the ground thus preventing the shoe from remaining at an undesirable position relative to ground. Instead the shoe is enabled to slide parallel to its underlying surface thus avoiding further inversion of the foot and subsequent transferral of kinetic energy to the connective tissues of the foot and ankle. Moreover, the reduced friction on the edge of the shoe enables the side of the shoe to slide easily parallel to the surface, so that even if a twist does occur, the energy transferred and thus the inversion torque is lowered sufficiently to avoid or reduce injury to the tissues.

The surface area of reduced friction at the lateral or medial connecting portion of the shoe, i.e. at the lateral or medial edge of the shoe, provides enhanced slip between the shoe and ground at isolated spots at the aforementioned connecting portions and edges. Hence, friction is differentiated in different areas of those parts of the shoe which are implicated in injury mechanisms. Injuries may thus be prevented in the long period with increased risk after an injury, and primary prophylaxis may be achieved in high risk sports. Patients with chronic ankle instability may also benefit life long from the invention.

In particular, the area of reduced friction prevents or significantly reduces the risk of excessive rotation of the wearer's foot relative to the ground when the load of the wearer's body is shifted towards or lands near the edge of the shoe. Accordingly, rather than rotating relative to ground, the shoe and hence the wearer's foot will tend to lose its grip with the surface, whereby the shoe and the foot will slip. As a result, the wearer will in most incidents fall due to loss of grip in the ground engaging area of reduced friction. The risk of general injury when the wearer falls is, however, significantly lower than the risk of ankle injury if the shoe had maintained its grip during unbalanced or uncontrolled motion of the wearer's foot while load is imparted. Furthermore, the area of reduced friction avoids that kinetic energy will increase in high and laterally protuberant basketball shoes due to an added vector since there is no rotation around the otherwise fixed lateral edge of the shoe. The area of reduced friction provided at the connecting portion(s) is particularly relevant for reducing the risk of excessive rotation of the wearer's foot relative to ground. This is because, during rotation of the wearer's foot relative to ground, the connecting portion(s) is more likely to engage the ground than the edges of the shoe. This is may be particularly relevant for reducing the risk of injuries caused by excessive rotation around an axis of rotation extending in the lengthwise direction of the wearer's foot.

The area of reduced friction provided at the lateral connection portion is most important since distortions to the medial side of the ankle joint is uncommon as compared to lateral distortions. However, the mechanism of lateral distortion applies to medial distortion as well.

In general, acceleration of the wearer of the shoe is made possible by the friction between the sole with a ground-engaging surface and the surface, relative to which the wearer wishes to accelerate. The present invention changes little if any of the frictional properties on the ground-engaging surface and thus does not change the ability of the shoe wearer to accelerate or stop relative to the ground. This is due to the fact that the area of reduced friction is provided at the lateral or medial connecting portions, which are not subject to any significant load unless the wearer is out of balance.

While the area of reduced friction, in some embodiments of the invention, is provided at the lateral connecting portion of the shoe, it may also or alternatively be provided at the medial connecting portion. The remarks made herein regarding the configuration, extent and effects of the area of reduced friction apply to the lateral and medial connecting portion alike, unless explicitly stated otherwise.

The surface of reduced friction preferably extends at least from a midfoot portion of the shoe towards the tip, i.e. toe portion of the shoe, as the forward portion of the shoe is of primary importance in relation to prevention of ankle injuries. In one embodiment of the invention, the area of reduced friction extends between 5% and 95% of the length of the shoe when measured from the shoe's toe portion towards its heel portion in order to provide the desired low-friction characteristics along an extended length of the shoe, notably its lateral connecting portion. The area of reduced friction that most frequently is of importance extends from 20-50% of the length of the shoe when measured from the toe portion towards the heel. However, extended areas have been found to be of relevance with regard to prevention of injuries, primarily ankle injuries. Albeit rarely involved in the initial mechanism of a distortion, in order to avoid that the shoe regains traction once it has started to slip, the area of reduced friction may extend into the rear part of the shoe, i.e. into an area between 60% and 100%, in particular between 60% and 95% of the length of the shoe when measured from the tip of the shoe towards its heel portion. Furthermore, areas of reduced friction at the rear part of the shoe may be of particular relevance in relation to loads occurring when one foot twists in front of the other one, as the rear part of the twisting foot engages the ground earlier in this case.

The extend of the area of reduced friction along the length of the shoe may depend on the shape of the shoe and/or the stiffness of the edges of the shoe. The shoe may be provided with areas of reduced friction at, at least one of the lateral and/or medial connecting portions and/or the lateral and/or medial edges of the shoe which defines a straight line when observed from above the shoe. In this case, if parts of the lateral edge and/or medial edge of the shoe defines at straight line in a given extend along the shoe, the shoe may be provided with an area of reduced friction at the connecting portion and/or edge of the shoe along the given extend of the shoe. This may further reduce the risk of injury in relation to excessive rotation of the wearer's foot, because the chance that the area of reduced friction is brought in contact with ground during excessive rotation may be increased.

Reduced friction in the toe portion of the shoe may be of particular importance in order to prevent the frequent injuries occurring due to a mechanism of early impact of the shoe in this front area resulting in a destabilised inversion already before the rear part of the shoe engages the ground.

More than one area of reduced friction may be provided at one of or each of the lateral and medial connection portions. For example, one area of reduced friction may be provided at the forward 10% length of the shoe, such as at a section extending from 5% to 10% of the length of the shoe at its lateral connecting portions, whereas a second area of reduced friction may extend at a section extending from 20% to 30% of the length of the shoe at the lateral connecting portion. Further or alternative areas of reduced friction may be provided, such as for example a first area extending between 5% and 60% of the length of the shoe, and a second area extending between 65% and 95% of the length of the shoe.

The shoe may be tailored relative to the foot of a human such that the surface of reduced friction at least covers an area of the connecting portion in the level of the caput of the fifth metatarsal bone of the foot, i.e. at approximately 40% of the length of the shoe when measured from a tip portion thereof towards its heel portion, and preferably also an area in the vicinity of the level of the fifth metatarsal bone, since this is the primary weight-bearing area of the lateral foot and thus of particular importance in prevention of transferral of harmful levels of kinetic energy to the surrounding tissues and ankle joint.

The shoe may define a foot part and a leg part, wherein the leg part extends no longer than a distance equal to one third of the distance from a wearer's knee to the farthest end of the wearer's heel. In this case, the shoe may be particularly suitable for use as a sports shoe because it may allow sufficient limb mobility for the wearer of the shoe to perform sports. In present context, the foot part is to be understood as the part of the shoe encompassing the wearer's foot. The leg part is to be understood as the part of the shoe vertically extending between the surface of the wearer's heel furthest from the wearer's knee and the part of the shoe closest to the wearer's knee. As such, the foot part and the leg part of the shoe overlap.

In present context, a sports shoe may be understood as a shoe suitable for wear when engaging in various forms of indoor and/or outdoor sports activities such as, e.g. football, basketball, volleyball, handball, floorball, tennis, badminton, dancing, table tennis, fitness, etc. Such shoe may also be referred to as an athletic shoe.

The shoe may define a foot part and a leg part, wherein the leg part extends no longer than a 1.25 times the longest straight-line extend of a wearer's foot. Thus the height of the leg part is thus at most equal to 1.25 times the length of the foot part, or at most equal to the length of the foot part, or smaller than then length of the foot part. The height of the leg part is preferably measured as a straight-line distance from the bottom of the sole of the shoe to an uppermost edge of the shoe for circumferentially surrounding the wearer's leg. In such embodiments, the shoe may be particularly suitable for use as a sports shoe because it may allow sufficient limb mobility for the wearer of the shoe to perform sports. In present context, the foot part is to be understood as the part of the shoe encompassing the wearer's foot. The leg part is to be understood as the part of the shoe vertically extending between the surface of the wearer's heel furthest from the wearer's knee and the part of the shoe closest to the wearer's knee. As such, the foot part and the leg part of the shoe overlap. The longest straight-line extend of the wearer's foot is commonly equal to the distance between the furthest ends of the wearer's toes and heel parallel to ground when the wearer is standing up.

The area(s) of reduced friction may be flush with the surrounding areas of the shoe. In other words, the area(s) of reduced friction may be arranged to not protrude from the surrounding areas of the shoe. In this case, the shape of the shoe may be essentially similar to the shape the shoe would have, if the shoe did not comprise the area(s) of reduced friction. Shoes according to these embodiments may be particularly beneficial for use as a sports shoe as the area(s) of reduced friction do not form undesired protrusions. Such undesired protrusions could possibly increase the harmful effects of an impact between such protrusions and another human being when the user is performing sports.

In embodiments of the present invention, the first coefficient of friction is preferably less than 0.5, more preferably at most 0.4 and most preferably at most 0.3 as tested according to ISO 13287:2012 by mounting the surface of the area of reduced friction on the sole of the test shoe and using the backward slip on the forepart test without lubricant as according to ISO 13287:2012. The coefficient of friction of each of the surrounding surface areas is preferably more than 0.55 as tested according to ISO 13287:2012 by mounting the surface of the area of reduced friction on the sole of the test shoe and using the backward slip on the forepart test without lubricant as according to ISO 13287:2012.

According to some embodiments of the present invention, the first coefficient of friction is different for different parts of the area of reduced friction. This may further prevent injuries. For instance, the coefficient of friction between the edge(s) of the shoe and the ground may be lower than the coefficient of friction between the connecting portion(s) and the ground. This may further promote sliding of the shoe when the edge of the shoe engages the ground and further prevent injuries, while the larger coefficient of friction between the connecting portion(s) and the ground allows the wearer to accelerate relative to ground to a larger degree. The friction may gradually change within the area of reduced friction. The different first coefficients of friction may be provided by a plurality of materials and/or different degrees of material coverage. Different degrees of material coverage may be provided so that the degree of material coverage is lowest near the ground engaging surface of the shoe, and increases as the distance to the ground-engaging surface increases.

The area of reduced friction may be formed by a layered structure comprising at least two layers, wherein the reduced friction is provided between the at least two layers. In this case, the layers may relatively easily move relative to each other. According to this embodiment, the area of reduced friction is not provided at the interface of the shoe and ground, but rather between the two layers of the layered structure. Thus, the reduced friction may be obtained irrespective of the nature of the ground engaged by the shoe. Accordingly, a more versatile shoe may be provided by present embodiment. This may be particularly beneficial for use of the shoe in outdoor sports. The layers may all extend in a direction parallel to the surface of the shoe. Each layer may be continuous or perforated.

Moving the layers relative to each other may require overcoming a certain mechanical energy barrier, i.e. it may require a certain initiation force to initiate movement of the layers relative to each other. This may be provided by adding a bonding means between at least two of the layers. The bonding material may then be broken by the initiation force. Such bonding means could be, e.g. strands, strings of polymer or cotton, an amount of bonding material provided along the rims of the layers, etc.

The surface area of reduced friction may be formed integrally with the shoe, such as integrally with at least one of the soles and/or one of said edges of the shoe, or it may be provided by a patch retrofitted on at least one of the soles and one of said edges of an existing shoe. The area of reduced friction may also be provided by coating the shoe with a material providing an area of reduced friction, e.g. by spray coating the relevant part(s) of the shoe. Coating of the shoe may be done with the aid of a template. This may ease the process of providing the area of reduced friction. An example of such a coating could be perfluoropolyether coating or silicone coating. Also lubricants can be applied to reduce the frictional properties of the shoe on areas mentioned. Such lubricant may comprise molybdenum disulphide ($MoS_2$).

The patch as disclosed and claimed herein may comprise a laminate structure comprising at least an adhesive layer and a opposed surface layer providing the area of reduced friction. A backing film, such as a release liner may further be provided with the laminate. In order to allow the patch to conform to double-curved shapes of most shoes, at least an upper edge of the patch may comprise a plurality of indentations, allowing the patch material to contract without wrinkling.

In the patch as disclosed and claimed herein, the opposed surface layer providing the area of reduced friction may include an outer most layer of polytetrafluoroethylene (PTFE). PTFE is known to have one of the lowest coefficients of friction against any solid. Other examples of materials which can be used for the opposed surface layer are various forms of polyethylene such as HD polyethylene and Ultra High Molecular Weight Polyethylene (UHMW-PE), fluorine or silicone based polymers and waxes. Other thermoplastic polymers or thermoset polymer can be used for the purpose of both patches and shoes. The outer most layer may be provided on a carrier material possibly with a silicone based adhesive on the surface opposite to the outer most layer. Furthermore, to improve adhesion of the patch to the shoe, the patch may include a double sided tape component situated between the outer most layer and the shoe. This double sided tape could consist of a Polypropylene film carrier and a hotmelt synthetic rubber adhesive. Alternatively it could consist of a paper tissue carrier and a hotmelt synthetic rubber adhesive. An additional alternative composition is a cloth carrier and a rubber adhesive. The adhesive may also comprise silicone, acrylic, rubber or any other suitable adhesive in the form of a hotmelt or pressure sensitive adhesive.

The PTFE may be provided on a carrier material possibly with a silicone based adhesive on the surface opposite to the PTFE. Furthermore, to improve adhesion of the patch to the shoe, the patch may include a double sided tape component situated between the PTFE covered component and the shoe. This double sided tape could consist of a Polypropylene film carrier and a hotmelt synthetic rubber adhesive. Alternatively it could consist of a paper tissue carrier and a hotmelt synthetic rubber adhesive. An additional alternative composition is a cloth carrier and a rubber adhesive.

The same surface materials may be applied in case the area of reduced friction is formed integrally with the shoe.

In an alternative embodiment, the area of reduced friction may be provided in the form of one or more strips made, e.g. from or surface coated with a metallic material or from a plastics material, such as any one of the above materials. The one or more strips may comprise polyethylene. In this case, the shoe may be particularly well suited for outdoor sports due to possibly the relatively high stiffness and smoothness of polyethylene.

In another alternative embodiment, the area of reduced friction may be provided in the form of a plurality of rotatable elements, such as spheres, partly embedded in and supported by the shoe. Such rotatable elements may provide an area with reduced friction with an increased lifetime, i.e. the area may have an improved ability to retain its reduced friction during extended use of the shoe.

The area(s) of reduced friction may be configured with poly-directional friction, i.e. different coefficients of friction along different directions. The area(s) of reduced friction may define one coefficient of friction when measured along a first direction and a second coefficient of friction when measured along a second direction. The first direction may be parallel with a line extending between the heel and the toe of the wearer of the shoe and the second direction may be parallel with a line extending between the heel and the knee of the wearer of the shoe. This may decrease the risk of injury for the wearer of the shoe, while providing adequate friction for certain types of movements desirable for the wearer. The poly-directional friction may be provided by provided the area(s) of reduced friction with, e.g. an outermost layer of fibres that preferentially bend along certain directions, ripples along certain directions, different molecular structures along certain directions, etc.

DESCRIPTION OF THE PREFERRED EMBODIMENTS

Preferred embodiments of the invention will now be described with reference to the accompanying drawings, wherein:

FIGS. 1 and 2 show first and second views of an embodiment of a shoe according to the invention;

FIG. 3 shows the shoe of FIGS. 1 and 2 mounted to a foot of a human wearer;

FIGS. 4 and 5 show first and second embodiments of a patch according to the invention;

Figure 9:
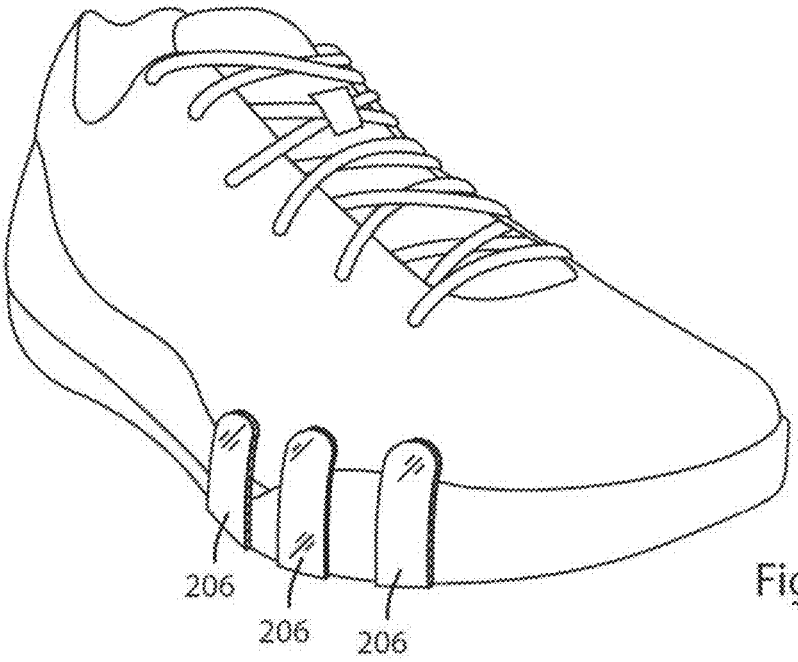

FIGS. 8(*a*) to 8(*e*) generally depicts various configurations of a shoe according to the invention;

FIG. 9 illustrates a further embodiment of a shoe according to the invention.

Figure 10:
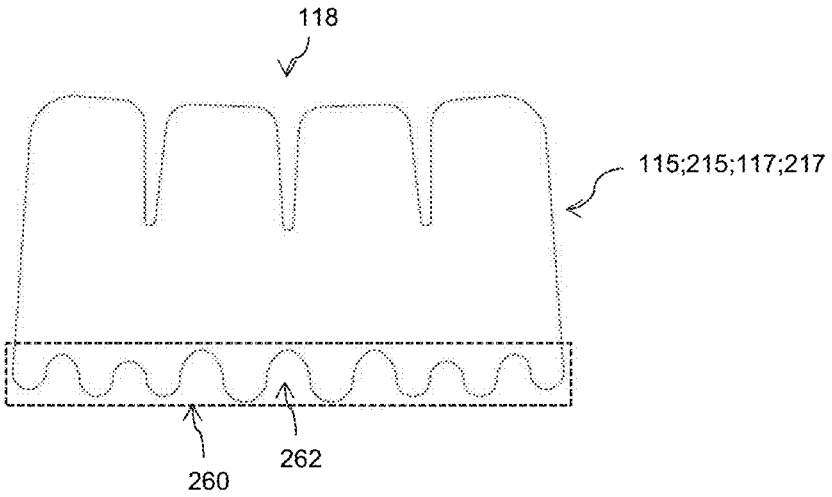

FIG. 10 illustrates an alternative embodiment of a patch according to the invention.

Figure 11:
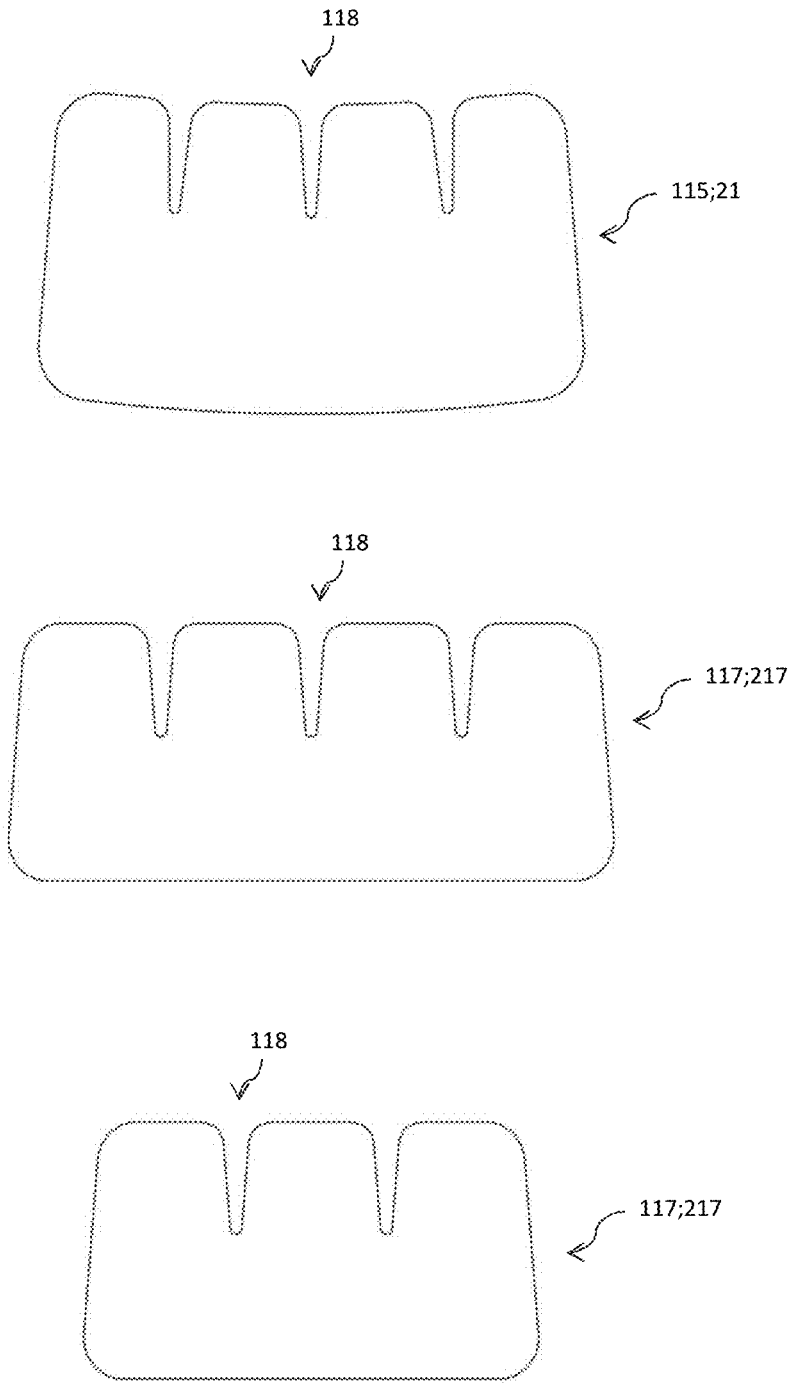
Figure 12:
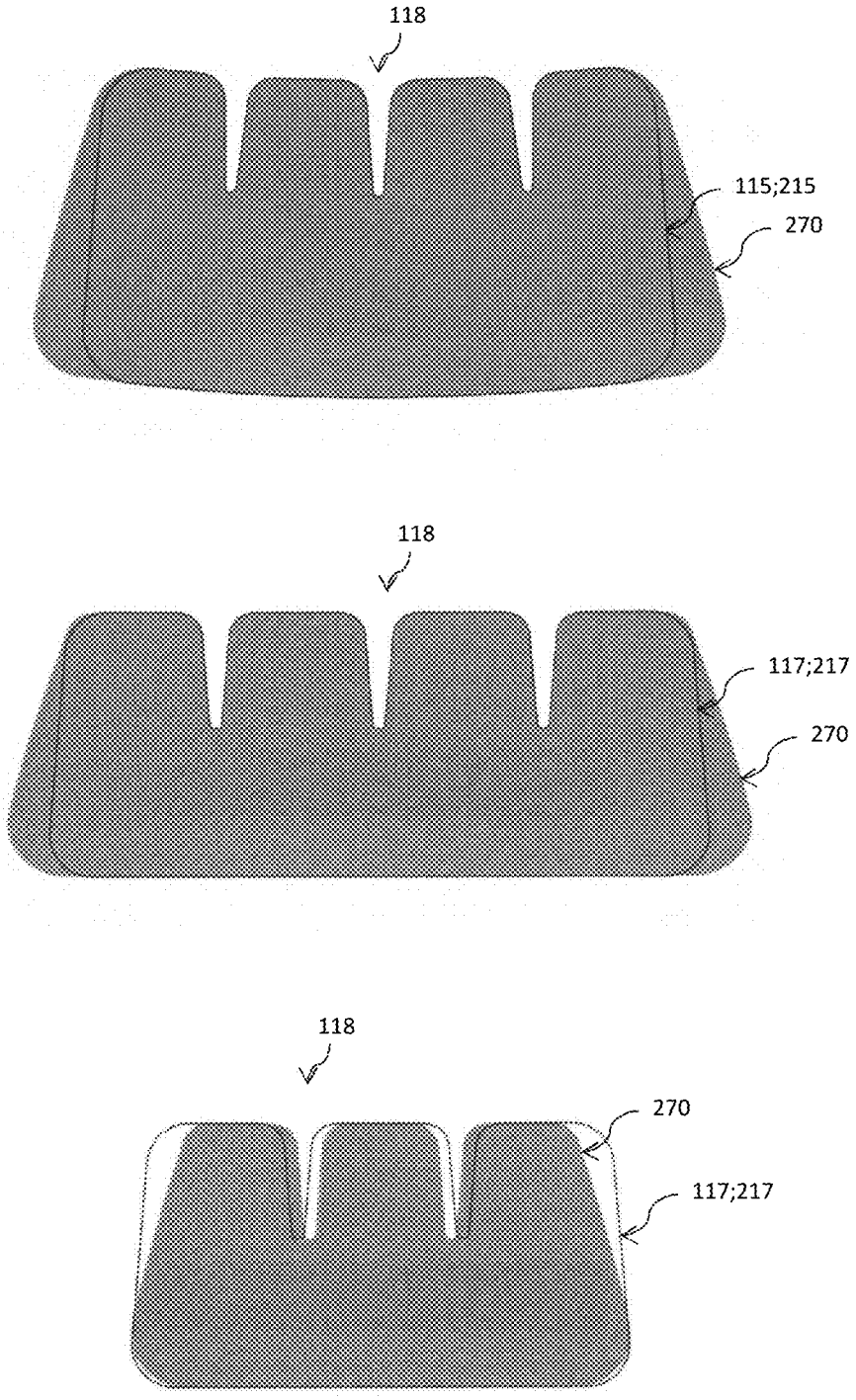

FIGS. 11 and 12 illustrate alternative embodiments of patches according to the invention.

Figure 13:
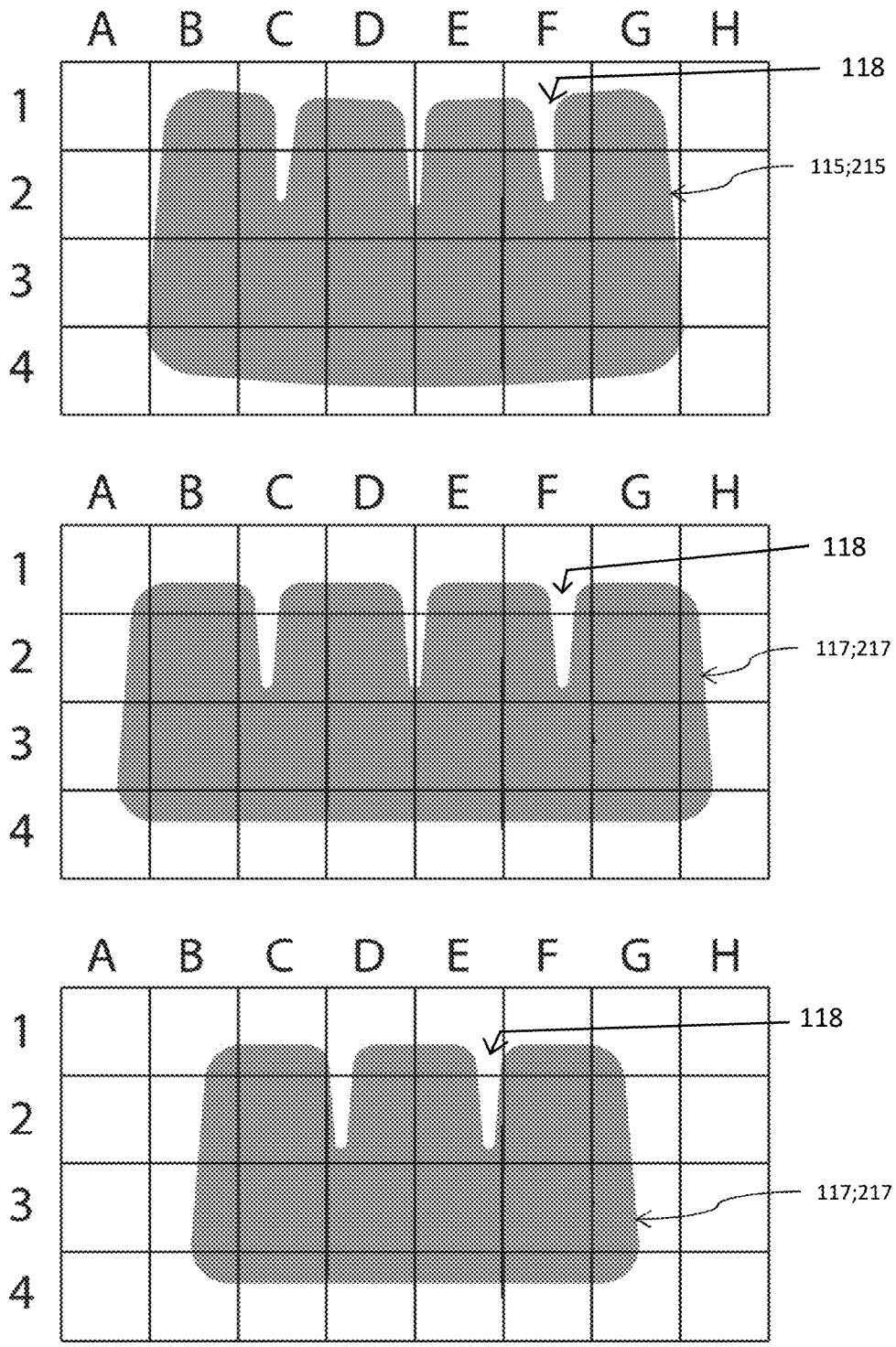

FIG. 13 illustrates alternative embodiments of scaled patches according to the invention.

DETAILED DESCRIPTION OF THE DRAWINGS

FIGS. 1-3 and 7 of the accompanying drawings show a shoe 100 comprising a sole 102 with a ground-engaging surface 104, and lateral edge 106 and a medial edge 108. A lateral connecting portion 110 interconnects and extends between the ground-engaging surface 104 of the sole 102 and the lateral edge 106, and a medial connecting portion 112 interconnects and extends between the ground-engaging surface 104 of the sole 102 and the medial edge 108.

Figure 7:
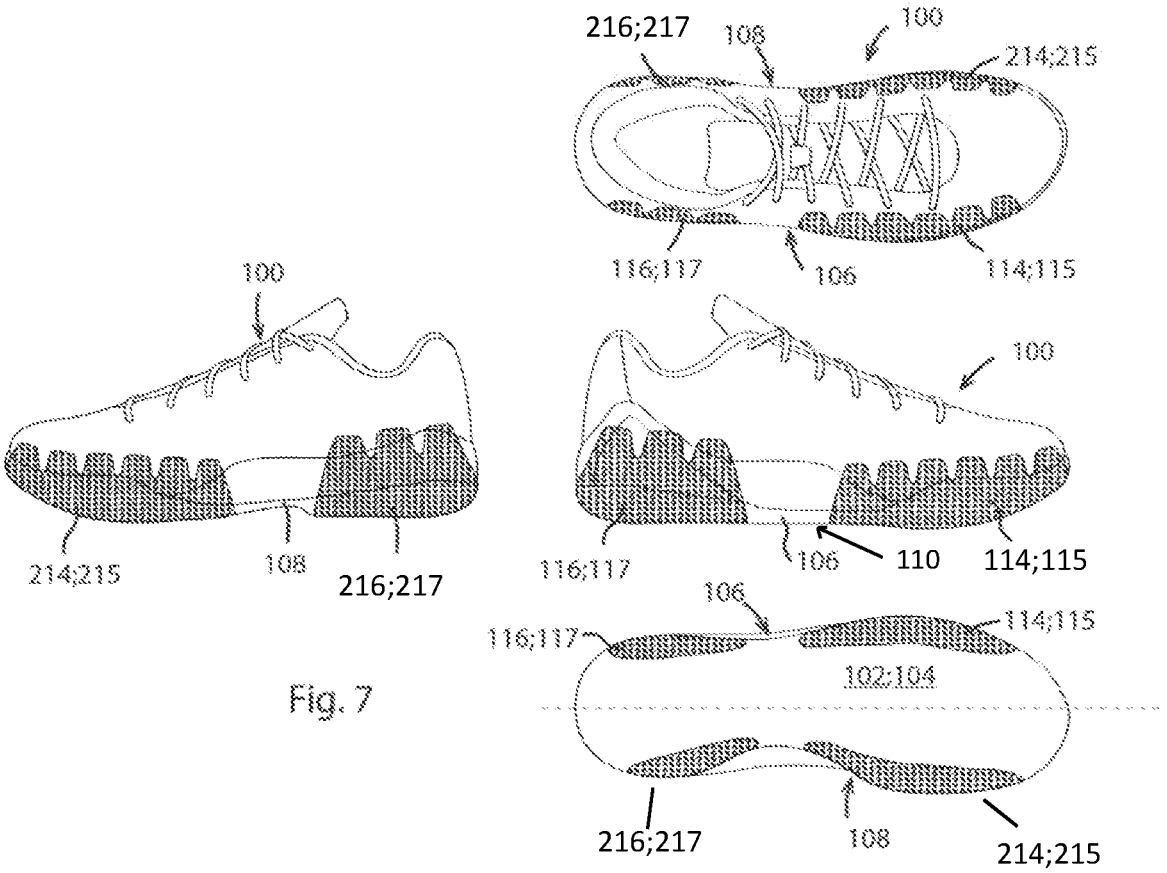
FIG. 7 illustrates an embodiment of a shoe comprising a patch according to the invention.
Figure 8A:
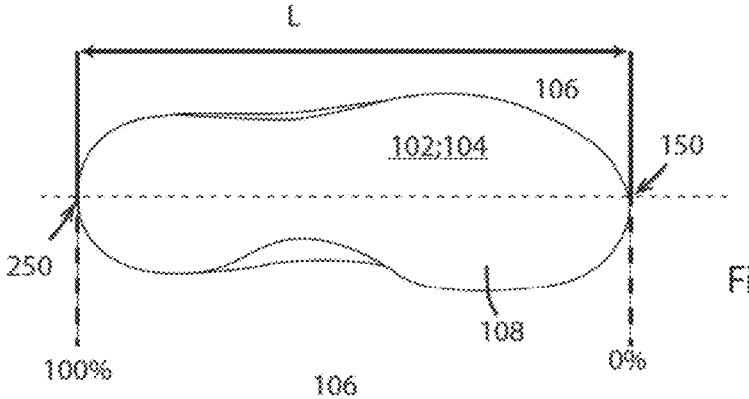
Figure 8B:
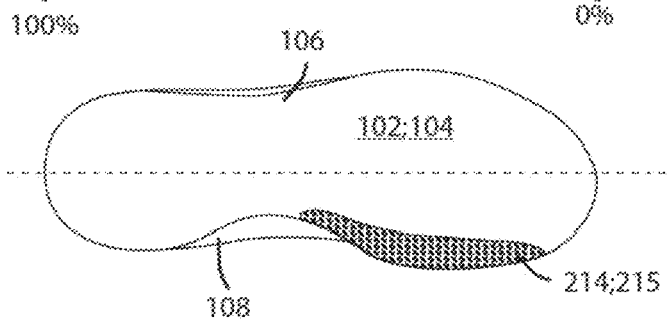
Figure 8C:
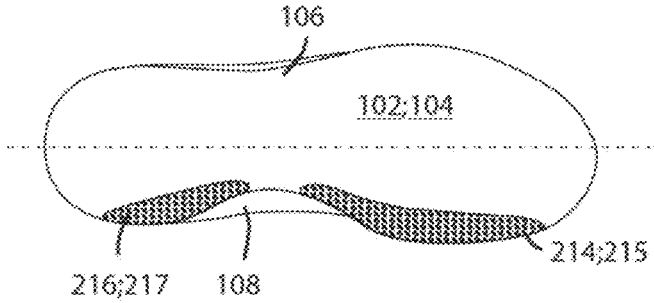
Figure 8D:
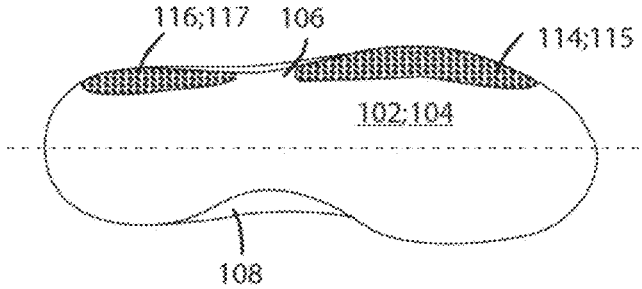
Figure 8E:
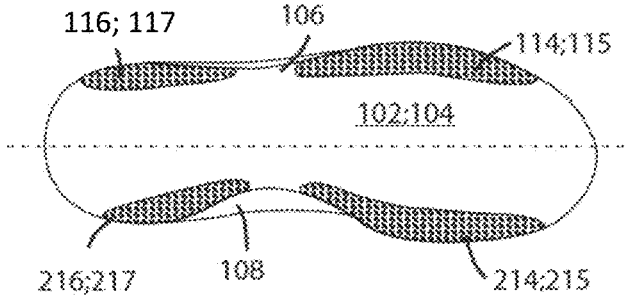

Areas of reduced friction 114, 214 and 116, 216 are provided at the lateral connecting portion 110 and the medial connecting portion 112, respectively. As shown in in FIGS. 1 and 7, the areas of reduced friction extend along part of the length of the shoe at its lateral edge 106 and extend from the ground-engaging surface 104 of the sole 102 and well into the lateral edge 106. The lateral edge 106 defines a top portion 122. The embodiment shown in FIG. 1 comprises two areas of reduced friction 114 and 116 at respective positions along the length of the shoe. The areas of reduced friction 114 and 116 are circumferentially surrounded by adjacent surface areas 103, 105, 107 of the shoe 100, which define a coefficient of friction higher than that of the areas of reduced friction 114, 116. In the embodiment of FIG. 7, areas of reduced friction 214 and 216 are further provided at the medial edge 108 of the shoe 100. As seen in FIG. 1, the areas of reduced friction 114, 116 extend a greater extent over the lateral edge 106 than the ground-engaging surface 104 of the sole 102. The areas of reduced friction 114, 116 extend above the top portion 122 of the lateral edge 106. The shoe 100 defines a substantially continuous outer surface over which the areas of reduced friction 114, 116 extend.

The areas of reduced friction 114, 214, 116 and 216 may be integrally formed with the remaining parts of the shoe 100, or they may be provided in the form of patches 115, 215, 117, 217 which can be retrofitted to an existing shoe. As shown in FIGS. 4, 5, 10, 11, 12 and 13 the patches 115, 215, and 117, 217 comprise indentations 118 at least at an upper edge 119 of the patch, allowing the patch to conform to the contour shape of the shoe and to contract without forming wrinkles.

Figure 6:
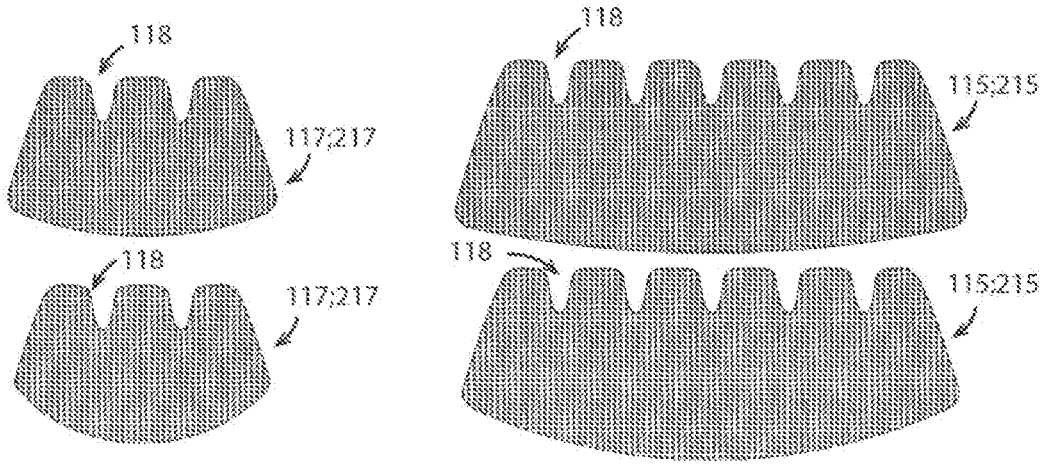
FIG. 6 illustrates alternative embodiments of patches according to the invention.

FIGS. 6, 11 and 12 illustrate alternative embodiments of patches 115, 117 according to the invention. The grey areas 270 in FIG. 12 illustrate examples of patch shape variations.

FIG. 8 generally depicts various configurations of a shoe according to the invention. FIG. 8*a* shows a sole 102 of a shoe, indicating its length L between 0% and 100% as measured from a tip portion 150 towards a heel portion 250 thereof. In the configuration of FIG. 8*b*, the show comprises a single area of reduced friction 214 only, provided by a patch 215 at the medial edge 108 at the forefoot region, i.e. between approximately 5% and 30% of the length of the shoe. The surface of reduced friction may extend between 5% and 95% of the length of the shoe when measured from the shoe's toe portion towards its heel portion. In an alternative configuration shown in FIG. 8*c*, the shoe comprises a medial forefoot patch 215 and a medial rear foot patch 217 extending approximately 2%-40% and 70%-95% of the length of the shoe, respectively. In a yet further alternative configuration illustrated in FIG. 8*d*, the shoe comprises two patches 115 and 117 at the lateral edge 106, extending approximately 10%-25% and 65%-85% of the length of the shoe, respectively. Finally, in the configuration of FIG. 8*e*, four patches 115, 117, 215, and 217 are provided at the lateral and medial edges 106 and 108, extending alternative lengths, as shown.

It should be understood that the configuration, arrangement and extent of the patches, including also the coverage of the sole and the side portions of the shoe (see FIGS. 1-3 and 7) may be varied according to the exact needs and the type of injury to be prevented.

FIG. 9 discloses a further embodiment of a shoe according to the invention, in which the area of reduced friction is provided in the form of a plurality of strips 206 from, e.g. a metallic or plastics material. The plastics material could be polyethylene.

FIG. 10 illustrates a patch 115, 215, 117, 217 that may be implemented at any or all of the lateral edges 106 and medial edges 108. In the embodiment of FIG. 10, the dashed box 260 indicates an area where a plurality of lower indentations 262 are provided. Accordingly, when the patch is attached to a shoe in a manner according to the invention, different degrees of patch material coverage is provided, so that the degree of material coverage is lowest near the ground engaging surface of the shoe, and increases as the distance to the ground-engaging surface increases. In this way, the friction between the shoe and the ground then gradually decreases as the distance to the ground-engaging surface increases within the dashed box 260.

FIG. 13 illustrates patches 115, 215, and 117, 217 drawn to scale. The horizontal and vertical axes have the same arbitrary units of length.

The invention claimed is:

1. A shoe comprising:

a sole with a ground-engaging surface;

a lateral edge and a lateral connecting portion interconnecting and extending between the ground-engaging surface of the sole and the lateral edge;

a medial edge and a medial connecting portion interconnecting and extending between the ground-engaging surface of the sole and the medial edge;

wherein said lateral connecting portion defines a surface area of reduced friction which is adjacent to at least one adjacent surface area of at least one of said lateral connecting portion, lateral edge, and ground-engaging surface, and which defines a first coefficient of friction; and wherein said first coefficient of friction is lower than a coefficient of friction of said at least one adjacent surface area;

wherein said surface area of reduced friction is provided at the lateral connecting portion;

wherein the first coefficient of friction is less than 0.5;

wherein the coefficient of friction of said at least one adjacent surface area is more than 0.55;

wherein the surface area of reduced friction extends continuously from a top portion of the lateral edge toward the ground-engaging surface such that the surface area of reduced friction mainly covers the lateral edge relative to the ground-engaging surface, and such that a small portion of the surface area of reduced friction extends slightly beyond the lateral connecting portion to cover a portion of the ground-engaging surface.

2. The shoe according to claim 1, wherein said surface area of reduced friction extends at least from a midfoot portion of the shoe towards a tip of the shoe.

3. The shoe according to claim 1, wherein said surface area of reduced friction extends between 5% and 95% of a length of the shoe when measured from a toe portion of the shoe towards a heel portion of the shoe.

4. The shoe according to claim 1 wherein the shoe is configured to fit a foot of a human, wherein said surface area of reduced friction is configured to at least cover an area of the lateral connecting portion in a level of the caput of the fifth metatarsal bone of the foot.

5. The shoe according to claim 1, wherein said surface area of reduced friction is formed integrally with the sole and the lateral edge of the shoe.

6. The shoe of claim 1, wherein the surface area of reduced friction is circumferentially surrounded by the lateral connecting portion, the lateral edge, and the ground-engaging surface.

7. The shoe according to claim 1, wherein said surface area of reduced friction is conferred by a patch retrofitted on the sole and the lateral edge of the shoe.

8. The shoe according to claim 7, wherein the patch comprises a laminate structure comprising at least an adhesive layer and an opposed surface layer providing said surface area of reduced friction.

9. The shoe according to claim 7, wherein at least an upper edge of the patch comprises a plurality of indentations.

10. A patch and a shoe, wherein the patch is configured for being retrofitted to the shoe, the patch and the shoe configured for preventing ankle injuries in a human being wearing the shoe, the patch being configured for mounting at:

a lateral edge and a lateral connecting portion interconnecting and extending between a ground-engaging surface of a sole and the lateral edge;

wherein the patch is configured to confer, to the shoe, a confined surface area, which is circumferentially surrounded by at least one adjacent surface area of the shoe, and which defines a coefficient of friction of less than 0.5;

wherein the surface area of reduced friction extends continuously from a top portion of the lateral edge toward the ground-engaging surface such that the surface area of reduced friction mainly covers the lateral edge relative to the ground-engaging surface, and such that a small portion of the surface area of reduced friction extends slightly beyond the lateral connecting portion to cover a portion of the ground-engaging surface.

11. A method of preventing ankle injuries in humans, comprising the steps of:

providing the human being with a shoe comprising a sole with a ground-engaging surface;

a lateral edge and a lateral connecting portion interconnecting and extending between the ground-engaging surface of the sole and the lateral edge;

a medial edge and a medial connecting portion interconnecting and extending between the ground-engaging surface of the sole and the medial edge;

wherein said lateral connecting portion defines a surface area of reduced friction which is adjacent to at least one adjacent surface area of at least one of said lateral connecting portion, lateral edge, and ground-engaging surface, and which defines a first coefficient of friction; and wherein said first coefficient of friction is lower than a coefficient of friction of said at least one adjacent surface area;

wherein said surface area of reduced friction is provided at the lateral connecting portion;

wherein the first coefficient of friction is less than 0.5;

wherein the coefficient of friction of the at least one adjacent surface area is more than 0.55;

wherein the surface area of reduced friction extends continuously from a top portion of the lateral edge toward the ground-engaging surface such that the surface area of reduced friction mainly covers the lateral edge relative to the ground-engaging surface, and such that a small portion of the surface area of reduced friction extends slightly beyond the lateral connecting portion to cover a portion of the ground-engaging surface; and mounting the shoe on a human foot, so as to promote sliding between the shoe and ground upon an occurrence of an unbalanced motion of the human foot relative to the ground.

12. A shoe comprising:

a sole with a ground-engaging surface;

a lateral edge and a lateral connecting portion interconnecting and extending between the ground-engaging surface of the sole and the lateral edge;

a medial edge and a medial connecting portion interconnecting and extending between the ground-engaging surface of the sole and the medial edge;

wherein said lateral connecting portion defines a surface area of reduced friction which is adjacent to at least one adjacent surface area of at least one of said lateral connecting portion, lateral edge, and ground-engaging surface, and which defines a first coefficient of friction;

wherein said first coefficient of friction is lower than a coefficient of friction of said at least one adjacent surface area;

wherein said surface area of reduced friction is provided at the lateral connecting portion; and wherein the surface area of reduced friction extends continuously from a top portion of the lateral edge toward the ground-engaging surface such that the surface area of reduced friction mainly covers the lateral edge relative to the ground-engaging surface, and such that a small portion of the surface area of reduced friction extends slightly beyond the lateral connecting portion to cover a portion of the ground-engaging surface.

13. A method of preventing ankle injuries in humans, comprising the steps of:

providing the human being with a shoe comprising a sole with a ground-engaging surface;

a lateral edge and a lateral connecting portion interconnecting and extending between the ground-engaging surface of the sole and the lateral edge;

a medial edge and a medial connecting portion interconnecting and extending between the ground-engaging surface of the sole and the medial edge;

wherein said lateral connecting portion defines a surface area of reduced friction which is adjacent to at least one adjacent surface area of at least one of said lateral connecting portion, lateral edge, and ground-engaging surface, and which defines a first coefficient of friction; and wherein said first coefficient of friction is lower than a coefficient of friction of said at least one adjacent surface area;

wherein said surface area of reduced friction is provided at the lateral connecting portion;

wherein the surface area of reduced friction extends continuously from a top portion of the lateral edge toward the ground-engaging surface such that the surface area of reduced friction mainly covers the lateral edge relative to the ground-engaging surface, and such that a small portion of the surface area of reduced friction extends slightly beyond the lateral connecting portion to cover a portion of the ground-engaging surface; and mounting the shoe on a human foot, so as to promote sliding between the shoe and ground upon an occurrence of an unbalanced motion of the human foot relative to the ground.

* * * * *